US005775146A

United States Patent [19]

Edwards et al.

[11] Patent Number: 5,775,146

[45] Date of Patent: Jul. 7, 1998

[54] LOCK WITH REMOVABLE CYLINDER

[75] Inventors: Charles Christopher Edwards; Grady A. Kelton, both of Greeneville, Tenn.

[73] Assignee: Hurd Corporation, Greeneville, Tenn.

[21] Appl. No.: 479,165

[22] Filed: Jun. 7, 1995

[51] Int. Cl.[6] ..... E05B 29/04

[52] U.S. Cl. ..... 70/369; 70/367; 70/377

[58] Field of Search ..... 70/367–369, 421, 70/339, 340

[56] References Cited

U.S. PATENT DOCUMENTS

| | | | |
|---|---|---|---|
| 480,299 | 8/1892 | Voight | 70/340 |
| 1,860,708 | 5/1932 | Falk | 70/340 |
| 1,957,851 | 5/1934 | Rubner | 70/340 |
| 3,940,958 | 3/1976 | Kuroki | 70/186 |
| 4,630,457 | 12/1986 | Kincaid | 70/369 |
| 4,672,827 | 6/1987 | Craig | 70/369 X |
| 4,715,201 | 12/1987 | Craig | 70/369 |
| 4,759,203 | 7/1988 | Lieb et al. | 70/185 |
| 4,884,423 | 12/1989 | Fancher | 70/248 |
| 5,101,649 | 4/1992 | Duval | 70/421 X |
| 5,121,618 | 6/1992 | Scott | 70/367 |
| 5,121,619 | 6/1992 | Murtin | 70/369 X |
| 5,226,304 | 7/1993 | Scott | 70/369 |
| 5,235,832 | 8/1993 | Lux et al. | 70/368 |
| 5,279,138 | 1/1994 | Gallagher | 70/369 X |
| 5,335,520 | 8/1994 | Lee | 70/369 X |
| 5,431,034 | 7/1995 | Fann et al. | 70/421 X |

FOREIGN PATENT DOCUMENTS

| | | | |
|---|---|---|---|
| 58607 | 2/1976 | Australia . | |
| 3040646 | 6/1981 | Germany | 70/369 |
| 8802327.3 | 5/1988 | Germany . | |

*Primary Examiner*—Steven N. Meyers
*Assistant Examiner*—Tuyet-Phuong Pham
*Attorney, Agent, or Firm*—Luedeka, Neely & Graham, P.C.

[57] ABSTRACT

A key lock tumbler cylinder is selectively removed with an extraction key that is longer than a normal operating key. The last tumbler plate in a tabular cylinder series along the cylinder key slot projects into an arcuate channel in the cylinder cavity wall of the lock body. This arcuate channel does not junction with the lock tumbler plate channel but does intersect with a second channel in the cavity wall that is angularly displaced about the cylinder axis from the tumbler plate channel. However, the second channel is more shallow than the arcuate channel to confine the tumbler cylinder within the body cavity when rotated by the operating key which does not engage the last tumbler plate key aperture. A second, tumbler cylinder extraction key that is longer than the operating key includes an edge bit at the end of the key for cooperating with the last tumbler plate key aperture. This end of the extraction key withdraws the last tumbler plate from the arcuate channel sufficiently to allow a tabular extension from the last tumbler plate blade to align with the second channel when the tumbler cylinder is rotated about the cylinder axis from the tumbler plate channel penetration position. In such a rotated position with the cylindrical extraction key, the tumbler cylinder may be extracted from the body cavity.

18 Claims, 3 Drawing Sheets

LOCK WITH REMOVABLE CYLINDER

BACKGROUND OF THE INVENTION

The present invention relates to key operated locks. More particularly, the invention relates to a lock tumbler cylindrical assembly that may be withdrawn from the lock body without disassembly from the lock secured appliance.

Office furniture locking systems respective to filing cabinets and desks have hereto developed along different size and style standards. Manufacturers of filing cabinets settled upon a key size standard that is smaller than that generally used for desk drawer locks. This difference has frustrated efforts to develop a uniform lock system having a single master key to operate all furniture locks in the office, department or section.

Although removable lock tumbler cylinders have been previously used in office furnishings, these removable cylinders have been pin tumbler types that require special tools, procedures and extensive disassembly for removal of the tumbler cylinder.

Most office circumstances having need for secure cabinet and desk space, also have a need for independent access to such secure space respective to both management and duty related employee needs. Ideally, each employee within an office complex could have a single distinctive key to access their personal desk and those file cabinets they have exclusive responsibility for. Simultaneously, it is highly desirable that management of the entire office complex have single key access to every secure space within the complex. Additionally, each of the individual lock sets should be easily and inexpensively altered to accommodate the circumstances of personnel changes without consequence to a master key system.

It is, therefore, an object of the present invention to provide a lock assembly having a secure but easily removed tumbler cylinder for changing the operative key profile.

Another object of the present invention is to provide an extremely small tumbler cylinder that will accommodate a standard key size.

Another object of the present invention is to provide a removable tumbler cylinder having plate tumblers.

Another object of the present invention is to provide a plate tumbler lock having a tumbler cylinder that is removable by means of a master key.

Another object of the present invention is to provide a key lock system having a master key code with few correlations to a use key code.

A still further object of the present invention is to provide a removable tumbler cylinder with plate tumblers in a standard, ½" wide file cabinet lock body.

SUMMARY OF THE INVENTION

These and other objects of the invention are accomplished by a file cabinet lock assembly having a removable tumbler cylinder with plate type tumblers. The tumbler cylinder comprises a cylindrical plug having a key slot along the plug axis. Distributed along the key slot length are a plurality of parallel plate tumblers oriented transversely to the slot length. These plate tumblers are confined in slots to guide reciprocating movement and are spring biased toward one direction of that movement. Each of the tumbler plates is provided with a key aperture through the plate mid-section with a divided key bit engaging edge for withdrawing the respective plate against a spring bias from a first spline channel in the wall of cylindrical cavity in the lock assembly body.

The last tumbler plate in the series most remote from the key slot mouth is provided with a tabular extension from the projected edge of the plate. This plate edge and tab are provided an arcuate channel in the assembly body cavity to accommodate rotation of the tumbler cylinder about the cylindrical axis. The first spline channel in the cavity does not junction with the arcuate channel. Meshing engagement of the last tumbler plate in the arcuate channel retains the tumbler cylinder from axial extraction from the cavity except when the tabular extension is aligned with a second spline channel in the cavity wall which does intersect the arcuate channel at partial depth. This second spline channel is angularly displaced around the cavity perimeter from the first spline channel thereby requiring, as a first step for access, key insertion to withdraw all the tumbler plates from the first spline channel. This is the normal function of an operating key that is of insufficient length to reach the aperture of the last tumbler plate. For the purpose of tumbler cylinder extractions, a longer, extraction key is provided to withdraw the plate from the arcuate channel except for the tabular extension. When the tumbler body is rotated to align the tabular extension with the second spline channel, the tumbler cylindrical may be axially extracted from the cavity for mechanical access to the tumbler plate and alteration of the operating key bit profile.

Rotation of the tumbler cylinder plug brings a cam surface at the internal end of the plug against a latch bolt yoke surface to displace the bolt from the extended, lock position against a spring bias. With the latch bolt withdrawn into the envelope of the assembly body, the entire body is axially displaced by a spring bias to release the cabinet drawer locking mechanism.

DETAILED DESCRIPTION OF THE PREFERRED EMBODIMENT

Figure 1:
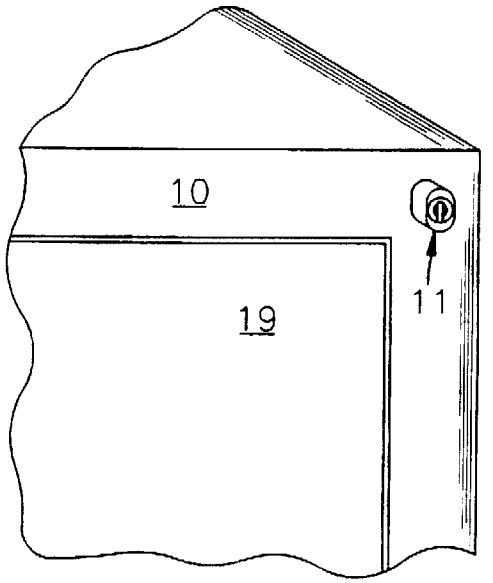
FIG. 1 is a partial perspective of a file cabinet secured by the present invention.
Figure 2:
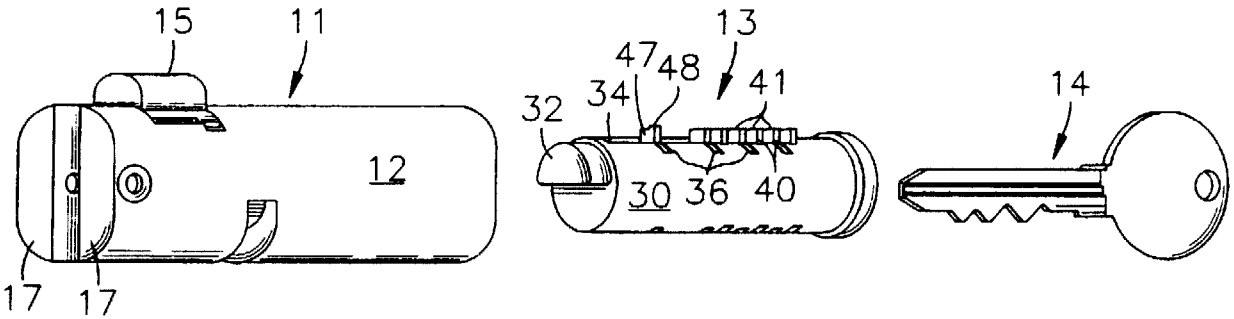
FIG. 2 is an exploded pictorial of the invention prime components.
Figure 5:
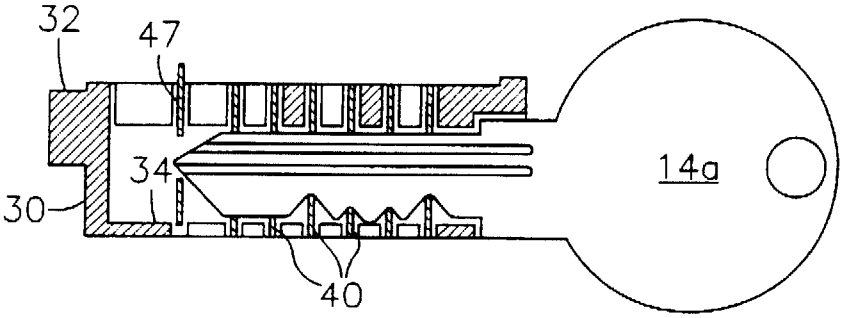
FIG. 5 is a sectional view of the invention tumbler cylinder with the insert combination of an operator key.
Figure 4:
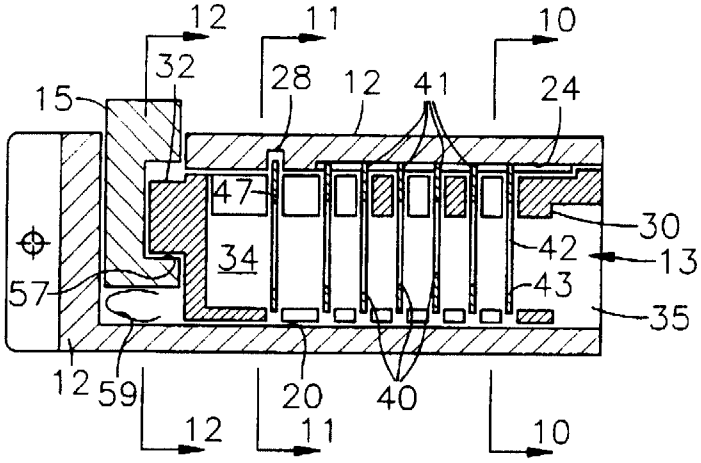
FIG. 4 is a sectional view of the invention lock assembly without the insert combination of a key.
Figure 9:
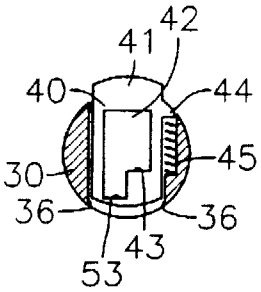
FIG. 9 is a cross-section of the invention tumbler cylinder showing the typical details of a plate tumbler.
Figure 13:
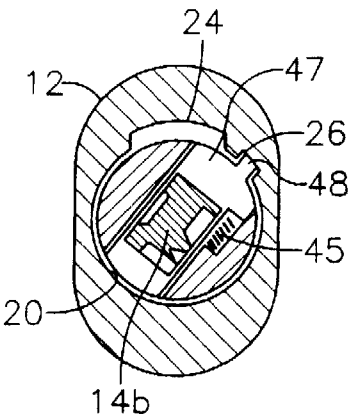
FIG. 13 is a sectional view of the invention illustrating the position of the cylinder retaining tab when the cylinder is extracted from the body cavity.
Figure 12:
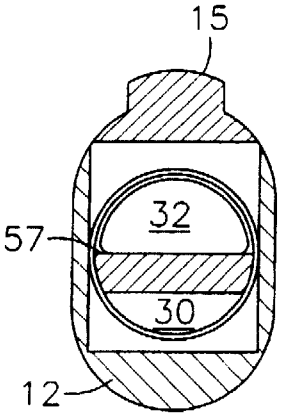
FIG. 12 is a sectional view of the invention assembly taken at station 12—12 of FIG. 4.

Referring now to the drawings wherein like reference characters designate like or similar elements throughout the several figures of the drawing, FIG. 1 represents the invention environment of a file cabinet 10 for enclosing a secure space that is accessed by drawers 19. Displacement of the drawers for access to the secure space is restricted by a lock assembly 11. A drawer locking mechanism of prior art configuration is actuated by the axial displacement of lock assembly 11. Illustrated by FIG. 1 is the projecting normally unlocked, status of the lock assembly 11. When locked, the assembly 11 is pushed to a flush planar face with the cabinet 10 face. A spring bias on the drawer locking mechanism, not shown, urges the lock assembly to the projected, unlocked position. This bias is opposed by the lock assembly latch bolt 15 which projects from the lock assembly body 12 as shown by FIG. 2 to engage a cabinet abutment surface not shown, a clip spring 59, as illustrated by FIGS. 4 and 5, for example, may be used to bias the latch bolt to the projected, locked position.

The latch bolt 15 is manually operated in opposition to the bias of spring 59 by key facilitated rotation of the tumbler cylinder 13. The lock assembly body is provided with a cylindrical cavity 20 to receive therein the tumbler cylinder 13. A cylindrical plug element 30 of the tumbler cylinder 13 has a cam element 32 formed integrally therewith or secured to the internal end of the plug 30. A yoke surface portion 57 of the latch bolt 15 is engaged by the cam 32 whereby partial rotation or angular displacement of the tumbler body about the cavity 20 axis will draw the bolt 15 against the bias of spring 59 into the envelope of the assembly body 12.

Clevis ears 17 flank a receptacle channel therebetween for receiving an operating bar element of the drawer locking mechanism which is attached by means of a threaded fastener not shown.

Figure 3:
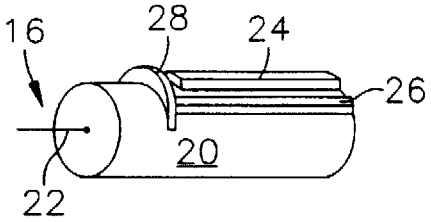
FIG. 3 is an isometric view of the invention receptacle cavity in reverse profile to illustrate channel patterns in the cavity wall.

With respect to FIG. 3, for clarity of description and illustration, the cavity 20 is represented in reverse profile as a mirror opposite plug 16. The cavity wall surface 20 is substantially a cylinder about the axis 22. Projecting radially from the cylinder wall surface are two spline channels 24 and 26 and an arcuate channel 28. Both spline channels open into the cavity 20 mouth. Particular note is to be given to the absence of a junction or connection between the first spline channel 24 and the arcuate channel 28. The second spline channel 26, which is angularly displaced about the cavity axis 22 from the center of the first spline channel, about 35°, for example, intersects with the arcuate channel 28 but at partial depth. At the point of juncture, arcuate channel 28 is deeper than the spline channel 26 as may be seen from the FIG. 11 section to provide a ledge between the arcuate channel bottom and the second spline channel bottom.

Cooperating functionally with the cavity channels are the tumbler plates 40 as shown by FIGS. 4–10. These tumbler plates are distributed along the length of a key slot 34 in and along the axis of the plug body 30. All of the plates are confined to parallel, reciprocable motion by guide slots 36 shown representatively by FIG. 9. Preferably, all of the plates 40 are biased toward one of two possible movement directions by springs 45 bearing against respective shoulders 44 to project a spline channel penetrating tongue portion 41 beyond the plug 30 cylindrical envelope.

Figure 8:
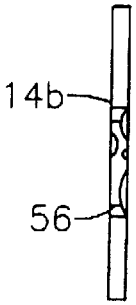
FIG. 8 is an end view of the master extraction key blade.
Figure 10:
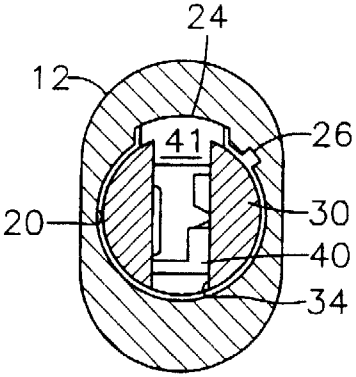
FIG. 10 is a sectional view of the invention assembly taken at station 10—10 of FIG. 4.

For the present invention, tumbler plate 47 is distinctive as the one most remote from the key slot mouth 35 and provided with a tabular extension 48 from the respective tongue portion as shown by FIGS. 2, 8 and 10.

All of the plates are also provided with a key aperture 42 for receiving the key 14 therethrough. Each aperture 42 is provided with a key bit follower edge 43. The dimensional distance between each tumbler plate follower edge 43 from the tip of the channel penetrating tongue 41 is coordinated with a corresponding key bit whereby engagement of the follower edge by the key bit will displace the plate 40 along the guide slots 36 against the bias of spring 45 sufficiently to withdraw the plate tongue portion 41 from penetrating proximity with the first spline channel 24. The operating key bit profile for a particular lock may be set by the discrete selection of tumbler plate bit engagement edges 43.

When an operating key is inserted along the key slot 34 through at least all of those tumbler plates engaging the first spline channel 24, the tongue portions of the plates are withdrawn from the spline channel thereby freeing the tumbler cylinder for rotation about the cavity axis 22 and displacement of the latch bolt 15.

However, because the distal plate 47 is carried in an arcuate channel 28, it is not necessary to extract the plate tongue from the arcuate channel to allow rotation of the tumbler cylinder. Accordingly, a lock operating key 14a for conventional security use need not be long enough to engage the last tumbler plate 47 as is represented by FIG. 5.

Figure 6:
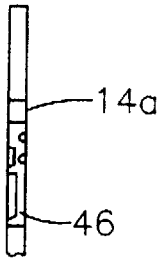
FIG. 6 is an end view of the operator key blade.
Figure 11:
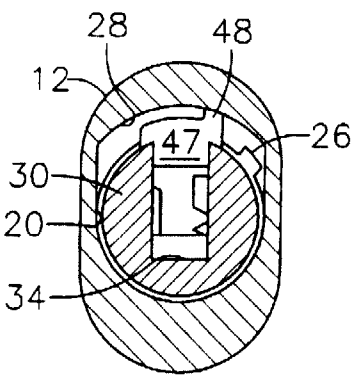
FIG. 11 is a sectional view of the invention assembly taken at station 11—11 of FIG. 4.

On those occasions when it is desired to change the operating key profile, usually by exchange of the entire tumbler cylinder 13, it is necessary to use a longer, master extraction key as represented by 14*b* of FIG. 6. The leading edge bit of this master extraction key 14*b* engages the aperture edge 53 respective to plate 47 to withdraw all of the plate tongue portion from the arcuate channel 28 except the tabular extension 48. However, the tabular extension is sufficiently withdrawn to clear the juncture ledge between second spline channel 26 and the arcuate channel 28. Accordingly, the extraction key 14*b* includes bit profile to withdraw all plates from the first spline channel 24 and permit rotation of the tumbler cylinder into angular alignment between the tabular extension 48 and the second spline channel 26 as shown by FIG. 11. In this state, the tumbler cylinder 13 may be extracted from the assembly body.

Figure 7:
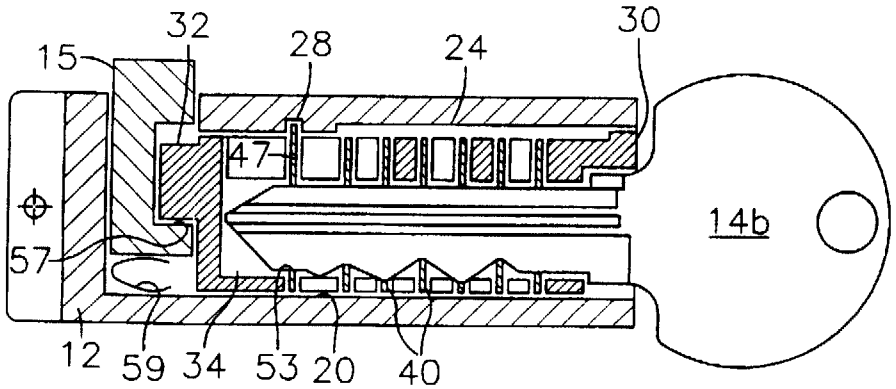
FIG. 7 is a cross-sectional view of the invention lock assembly with the insert combination of a master extraction key.

Greater length of the master extraction key 14*b* is not the only distinction from the operator key 14*a*. It will be noted from FIG. 7 that the tumbler plate 40 shows a stair-step difference between bit follower edges 43 and 53. The illustrated embodiment of the invention relates the edge bits of operator key 14a to the bit follower edges 43. The respective key blades are asymmetric. The operator key 14*a* has its edge bit profile 46 along one side of the blade as illustrated by FIG. 5 in the plane of plate follower edges 43. The master extraction key 14*b* has its edge bit profile 56 along the other side of the key blade as illustrated by FIG. 7 in the plane of plate follower edges 53. The respective plate follower edge profiles may be substantially independent of each other. Consequently, the master extraction key 14*b* is provided a bit profile sequence for rotating the tumbler cylinder having no similarity to the bit profile sequence selected for the operating key 14*a*. Accordingly, all locks in a rotated set may be opened with the same master extraction key 14*b* but at the same time, individual locks are unlocked by distinctive operator keys.

It will be understood by those of ordinary skill in the art that rotation of the tumbler cylinder 13 may be applied to other latching mechanisms. For example, an eccentric may be used in lieu of the cam 32. In a different body member, a rotating latch bar may be secured to the end of the plug 30. Additionally, rotation of the tumbler cylinder may be applied for opening or closing electrical contacts.

Because the present invention does not require equipment or furniture disassembly to change the tumble plate sequence within an assembly, it is possible to quickly and conveniently match all security enclosures within a given office or room to a single operating key profile. However, because of the uniqueness of the extraction key, such convenience does not compromise the enclosure security.

As our invention, therefore,

We claim:

1. A key operated cylinder lock assembly comprising a body member, a tumbler cylinder member and a latch member, said body member including a substantially cylindrical cavity within a cylindrical wall formed about a cylinder axis, said cylindrical wall having a pair of spline channels therein extending substantially parallel with said cylinder axis, said tumbler cylinder member comprising a plug having a substantially cylindrical surface configured and dimensioned to fit axially and rotatively within said cavity, said tumbler cylinder further comprising a key receptacle slot therein extended along an axial length, said slot being aligned substantially diametrically within said plug and a plurality of substantially parallel plane tumbler plates distributed along the axial length of said slot, said tumbler plates having a tongue element with a tongue width that is oriented substantially transversely to the slot length and confined in respective guide slots, each tumbler plate being slidably disposed within its respective guide slot and resiliently biased toward one radial edge of said key receptacle slot for projection of said tongue element beyond the cylindrical surface of said plug and into a first of said spline channels in said cylindrical wall, said first spline channel having a width corresponding to said tongue width to prevent rotation of said tumbler cylinder about said cylinder axis, each of said tumbler plates also having a key aperture therein aligned to receive an operating key therethrough for withdrawing said tongue elements from said first spline channel thereby permitting said latch member to be operated by rotation of said tumbler cylinder about said cylinder axis, at least one of said tumbler plates having a tabular extension from said tongue element with a width substantially less than said tongue width, a second of said cylindrical wall spline channels having width corresponding to the width of said tabular extension, an arcuate channel in said cylindrical wall in planar alignment with said one tumbler plate to rotatively pass said tabular extension through said arcuate channel for a partial circle of rotation when the remainder of said plurality of tumbler plates are withdrawn from said first spline channel by insertion of said operating key through said apertures but preventing axial withdrawal of said tumbler cylinder from said cavity, said first spline channel having no open junction with said arcuate channel and said second spline channel having an open junction with said arcuate channel.

2. A lock assembly as described by claim 1 wherein said tumbler plates are distributed serially along the length of said key slot from a slot mouth for receiving said operating key there within, said one tumbler plate having said tabular extension being the most remote tumbler plate from said slot mouth.

3. A lock assembly as described by claim 2 wherein said arcuate channel has a depth greater than the depth of said first spline channel corresponding to the tabular extension of said one tumbler plate.

4. A lock assembly as described by claim 3 wherein the key aperture of said one tumbler plate is engaged by an extraction key that is longer than said operating key, said extraction key having an edge bit positioned to displace said one tumbler plate to a position of tabular extension alignment with a depth of said second spline channel whereby said tumbler cylinder may be rotated to an angle of axial alignment of said tabular extension with said second spline channel and permit extraction of said tumbler cylinder from said cavity.

5. A lock assembly as described by claim 1 wherein each of said tumbler plate key apertures has at least two key bit follower edges, said follower edges respective to all plates aligned to receive said operating key being disposed in a first alignment plane corresponding to one of two key blade sides and follower edges respective to all plates aligned to receive a tumbler cylinder extraction key being disposed in a second alignment plane corresponding to the other key blade side.

6. A lock assembly as described by claim 5 having a key bit edge profile respective to said operating key that is independent of a key bit edge profile respective to said extraction key.

7. A lock assembly as described by claim 1 wherein said latch member is a reciprocated bolt confined to bolt guides within said body member and operated by rotation of said tumbler cylinder.

8. A lock assembly as described by claim 7 wherein displacement of said bolt is resiliently biased from said body member.

9. A lock assembly as described by claim 7 wherein said tumbler cylinder includes a cam member secured to an internal end of said cylindrical plug, said cam member engaging a yoke portion of said bolt for bolt displacement by rotation of said tumbler cylinder.

10. A lock assembly as described by claim 7, wherein said tumbler cylinder includes an eccentric member secured to an internal end of said cylindrical plug, said eccentric member engaging a yoke portion of said bolt for bolt displacement by rotation of said tumbler cylinder.

11. A file cabinet locking assembly comprising a body member, a tumbler cylinder member and a latch member, said body member including a substantially cylindrical cavity delineated by a cylindrical wall about a cylinder axis, said cavity having spline channels in said cylindrical wall extending substantially parallel with said cylinder axis, said tumbler cylinder comprising a substantially cylindrical plug configured and dimensioned to fit axially and rotatively within said cavity, said tumbler cylinder further comprising a key receptacle slot therein extended along an axial length, said slot being aligned substantially diametrically within said tumbler cylinder and a plurality of substantially parallel plane tumbler plates distributed along the axial length of said key slot, said tumbler plates being oriented substantially transversely to the key slot length and confined in respective guide slots, said tumbler plates also being slideably disposed within respective guide slots and resiliently biased in one sliding direction common to the other of said tumbler plates, said tumbler plates having integral blades protecting therefrom for penetration into a first of said spline channels, said blades having a width corresponding with a width of said first spline channel to prevent rotation of said tumbler cylinder about said cylinder axis, each of said tumbler plates having a key aperture with a key bit engagement edge whereby insertion of an operating key along said key slot engages a key edge bit with a corresponding tumbler plate aperture edge to slideably withdraw the corresponding tumbler plate blades from said first spline channel, an arcuate channel in said cylindrical wall having a partial circle arc in substantial planar alignment with at least one of said tumbler plates to receive the blade respective to said one tumbler plate and a tabular extension of said respective blade, said tabular extension having a width that is substantially less than said blade width and substantially corresponding to the width of a second spline channel in said cylindrical wall, said arcuate channel having a greater depth into said cylindrical wall than said first and second spline channels, open junctioned with said second spline channel and no junction with said first spline channel.

12. A file cabinet locking assembly as described by claim 11 wherein said tumbler plates are distributed serially along said key slot length from a slot mouth for receiving said operating key therewithin, said one tumbler plate being the most remote tumbler plate from said mouth and having said tabular extension from the respective blade aligned to penetrate said arcuate channel.

13. A file cabinet locking assembly as described by claim 12 wherein said arcuate channel has a depth greater than the depth of said first spline channel by the approximate length of said tabular extension.

14. A file cabinet locking assembly as described by claim 13 wherein said operating key has an effective length, that is insufficient to engage the key aperture of said one tumbler plate.

15. A file cabinet locking assembly as described by claim 14 wherein the key bit aperture edge respective to said one tumbler plate is engaged by a corresponding extraction key edge bit, said extraction key being longer than said operating key and said corresponding extraction key edge bit positioned to displace said one tumbler plate along its respective guide slot whereat said respective tabular extension is positioned in depth alignment with said second cavity spline channel whereby said tumbler cylinder may be rotated to an angle of axial alignment of said tabular extension with said second spline channel and permit extraction of said tumbler cylinder from said cavity.

16. A file cabinet locking assembly as described by claim 11 wherein each of said tumbler plate key apertures has at least two key bit engagement edges, key bit engagement edges respective to those plates aligned to receive said operating key being disposed in a first alignment plane corresponding to one of two key blade sides and bit engagement edges respective to those plates aligned to a tumbler cylinder extraction key being disposed in a second alignment plane corresponding to the other of said two key blade sides.

17. A file cabinet locking assembly as described by claim 11 having a first key bit edge profile respective to said operating key formed in said one key blade side and a second key bit edge profile respective to said tumbler cylinder extraction key is formed in said other key blade side.

18. A file cabinet locking assembly as described by claim 17 wherein said first key bit edge profile is independent of said second key bit edge profile.

* * * * *

UNITED STATES PATENT AND TRADEMARK OFFICE

CERTIFICATE OF CORRECTION

PATENT NO. : 5,775,146

DATED : July 7, 1998

INVENTOR(S) : Charles Christopher Edwards and Grady A. Kelton

It is certified that error appears in the above-identified patent and that said Letters Patent is hereby corrected as shown below:

On the title page, item [57],
Line 3, delete "tabular" and insert -- tumbler --.

Line 16, after "and" insert -- bit --.

Signed and Sealed this

Twenty-ninth Day of September, 1998

Bruce Lehman

*Attest:*

BRUCE LEHMAN

*Attesting Officer*

*Commissioner of Patents and Trademarks*